United States Patent [19]

Pastva, Jr. et al.

[11] 4,312,202

[45] Jan. 26, 1982

[54] PADDLE LOCK WITH BOLT-CARRIED HANDLE DISCONNECT MEMBER

[75] Inventors: John V. Pastva, Jr., Parma Heights; Albert L. Pelcin, Aurora, both of Ohio

[73] Assignee: The Eastern Company, Cleveland, Ohio

[21] Appl. No.: 107,859

[22] Filed: Dec. 28, 1979

[51] Int. Cl.[3] ..... E05B 55/10

[52] U.S. Cl. ..... 70/472; 70/149; 70/218; 70/489; 292/173; 292/DIG. 27; 292/DIG. 31

[58] Field of Search ..... 70/472, 488, 489, 149, 70/204, 218, 208, 221–224, 416; 292/167, 173, 223, 226, DIG. 27, DIG. 31, DIG. 37

[56] References Cited

U.S. PATENT DOCUMENTS

| | | | |
|---|---|---|---|
| 5,492 | 3/1848 | Pye | 292/DIG. 27 X |
| 95,507 | 10/1869 | Petre | 292/DIG. 27 X |
| 269,953 | 1/1883 | Moritz . | |
| 528,450 | 10/1894 | Swanberg . | |
| 1,751,184 | 3/1930 | Wodarra . | |
| 1,785,381 | 12/1930 | Holtzman . | |
| 1,840,062 | 1/1932 | Taylor . | |
| 1,909,210 | 5/1933 | Miller . | |
| 1,911,564 | 5/1933 | Gahagan . | |
| 1,960,410 | 5/1933 | Christensen . | |
| 1,964,066 | 6/1934 | Kuszmaul . | |
| 2,053,805 | 9/1936 | Van Note . | |
| 2,075,948 | 4/1937 | Kuszmaul . | |
| 2,117,715 | 5/1938 | Godfried . | |
| 2,274,455 | 2/1942 | Murphy . | |
| 2,322,892 | 6/1943 | Springer . | |
| 2,453,505 | 11/1948 | Fornwald . | |
| 2,459,029 | 1/1949 | Ingres et al. . | |
| 2,468,644 | 4/1949 | Springer . | |
| 2,582,928 | 1/1952 | Dall . | |
| 2,603,963 | 7/1952 | Allen . | |
| 2,629,618 | 2/1953 | Roethel . | |
| 2,649,321 | 8/1953 | Smith . | |
| 2,658,781 | 11/1953 | Allen . | |
| 2,700,290 | 1/1955 | Dall . | |
| 2,705,882 | 4/1955 | Craig . | |
| 2,705,884 | 4/1955 | Craig . | |
| 2,723,145 | 11/1955 | Smith . | |
| 2,728,214 | 12/1955 | Craig . | |
| 2,772,908 | 12/1956 | Craig . | |
| 2,773,716 | 12/1956 | Craig . | |
| 2,782,062 | 2/1957 | Smith . | |
| 2,877,043 | 3/1959 | Leslie . | |
| 2,955,864 | 10/1960 | Van Voorhees . | |
| 2,978,895 | 4/1961 | Heisler . | |
| 2,987,907 | 6/1961 | Cockburn et al. . | |
| 3,007,731 | 11/1961 | Roethel . | |
| 3,069,889 | 12/1962 | Johnstone et al. . | |
| 3,104,124 | 9/1963 | Beck . | |
| 3,121,580 | 2/1964 | Di Salvo et al. . | |
| 3,129,026 | 4/1964 | Gergoe et al. . | |
| 3,153,551 | 10/1964 | Sandor et al. . | |
| 3,171,677 | 3/1965 | Klove, Jr. et al. . | |
| 3,309,127 | 3/1967 | Pickles . | |
| 3,314,708 | 4/1967 | Welch . | |
| 3,386,760 | 6/1968 | Bessette . | |
| 3,394,957 | 7/1968 | Foley . | |
| 3,423,117 | 1/1969 | Klove, Jr. et al. . | |
| 3,587,259 | 6/1971 | Sandor . | |
| 3,649,061 | 3/1972 | Meyer . | |
| 3,672,713 | 6/1972 | Pickles . | |
| 3,679,251 | 7/1972 | Brockman et al. . | |
| 3,695,660 | 10/1972 | Fetters . | |
| 3,695,663 | 10/1972 | Cockburn . | |
| 3,697,105 | 10/1972 | Marx . | |
| 3,807,203 | 4/1974 | Larsen | 70/149 |
| 4,116,027 | 9/1978 | Tannery . | |
| 4,170,119 | 10/1979 | Kalis, Jr. | 70/149 X |
| 4,170,119 | 10/1979 | Kalis, Jr. . | |

FOREIGN PATENT DOCUMENTS

| | | |
|---|---|---|
| 135399 | 9/1947 | Australia . |
| 717308 | 2/1942 | Fed. Rep. of Germany . |

*Primary Examiner*—William E. Lyddane
*Attorney, Agent, or Firm*—Burge & Porter Co.

[57] ABSTRACT

A door lock has a flush-mountable body. A forwardly facing recess is defined by the body. A paddle-type handle is pivotally carried by the body and is movable between a nested position within the body recess and an operating position. A spring-projected slide bolt is carried on the back of the body and is movable between projected and retracted positions. A key-controlled disconnect linkage is provided for selectively connecting and disconnecting the handle and the bolt. The linkage includes a disconnect member which is movably mounted on the bolt. The disconnect member is moved by a key-operated cam between connecting and disconnecting positions. When the disconnect linkage drivingly connects the handle and the bolt, movement of the handle from its nested position to an operating position will cause corresponding retracting movement of the bolt. When the disconnect linkage disconnects the handle from the bolt, movement of the handle is inoperative to cause retracting movement of the bolt. A feature of the disconnect linkage is that it provides the lock with a "slam" capability, meaning that when the bolt is projected, it can be slammed into latching engagement with a suitably configured strike regardless of whether the disconnect linkage is drivingly connecting or disconnecting the handle and the bolt.

8 Claims, 6 Drawing Figures

PADDLE LOCK WITH BOLT-CARRIED HANDLE DISCONNECT MEMBER

CROSS-REFERENCE TO RELATED APPLICATIONS

PADDLE LOCKS WITH HANDLE DISCONNECT FEATURES, Ser. No. 108,007 filed concurrently herewith on Dec. 28, 1979 by John V. Pastva, Jr., hereinafter "Disconnect Case I."

PADDLE LOCK WITH PIVOTALLY MOUNTED HANDLE DISCONNECT MEMBER, Ser. No. 108,010 filed concurrently herewith on Dec. 28, 1979 by Albert L. Pelcin, hereinafter "Disconnect Case II."

PADDLE LOCK WITH ROTATABLY-MOUNTED HANDLE DISCONNECT MEMBER, Ser. No. 107,859 filed concurrently herewith on Dec. 28, 1979 by James A. Reed and Edwin W. Davis, hereinafter "Disconnect Case IV."

PADDLE LOCK WITH TRANSLATABLY-MOUNTED HANDLE DISCONNECT MEMBER, Ser. No. 108,017 filed concurrently herewith on Dec. 28, 1979 by Edwin W. Davis, hereinafter "Disconnect Case V."

PADDLE LOCK WITH HANDLE DISCONNECT, Ser. No. 108,016 filed concurrently herewith on Dec. 28, 1979 by Jye P. Swan, John V. Pastva, Jr. and Donald J. Dignan, hereinafter "Disconnect Case VI."

PADDLE LOCK WITH GUARD-PROTECTED HANDLE DISCONNECT MEMBER, Ser. No. 107,858 filed concurrently herewith on Dec. 28, 1979 by Edwin W. Davis, hereinafter "Disconnect Case VII."

FLUSH-MOUNTABLE LOCK WITH ACTUATOR DISCONNECT FEATURE, Ser. No. 108,011 filed concurrently herewith on Dec. 28, 1979 by Edwin W. Davis, hereinafter "Disconnect Case VIII."

The present application and the applications cross-referenced above have been assigned to a common entity, The Eastern Company, a corporation of Connecticut.

BACKGROUND OF THE INVENTION

1. Field of the Invention

The present invention relates generally to a door lock having a spring-projected slide bolt, a handle for retracting the bolt, and a key control for selectively permitting and preventing the handle from retracting the bolt. More particularly, the invention relates to a lock of this type including a key-controlled disconnect linkage for selectively drivingly connecting and disconnecting the handle and the bolt, whereby the handle is, at all times, freely movable between normal and operating positions, but is functional only when the key control is "unlocked"to enable the handle to retract the bolt.

While the present invention has particularly advantageous use in conjunction with flush-type door locks used on swinging doors of vehicles, industrial cabinets, electrical equipment enclosures and the like, principles of the invention are not limited in application to such uses.

2. Prior Art

Flush-type door locks including a body, a lock bolt slidably carried on the body, and an operating handle for moving the bolt relative to the body are well known. Normally the handle is in a flush or nested position when the bolt is projected. Bolt retraction is effected by pivoting the handle to an operating position. Locks of this type are well suited for use on swinging doors of vehicles such as trucks, on merchandise, tool and equipment cabinets, electrical equipment enclosures and the like.

Flush-type, paddle-handle door locks employing key-operated rotatable cams for selectively permitting and preventing unlocking movements of operating handles, and having spring-projected slide bolts, are described in U.S. Pat. Nos. 3,707,862, and 3,668,907 granted Jan. 2, 1973 and June 13, 1972, respectively, to John V. Pastva, Jr. An ornamental appearance employed in locks of this general type is illustrated in U.S. Des. Pat. No. 230,132 issued Jan. 29, 1974 to John V. Pastva, Jr.

The provision of a handle disconnect feature in a door lock is desirable in that the presence of such a feature will lessen, if not totally eliminate, incidents of these locks being damaged by would-be intruders. Since the handles of most previously proposed door locks are restrained from moving when the locks are locked, it is common for would-be intruders to attempt to gain entry by applying excessive leverage force to the lock handles. Where handle disconnect features are provided, the lock handles may always be moved freely, but are functional to retract the lock bolts only when the locks are "unlocked." Locks having handle disconnect features can be made practically entry-proof short of the application of such forces as will totally destroy the locks.

Door locks employing various types of handle disconnect systems have been proposed. Prior proposals have, however, suffered from a variety of drawbacks including complexities of construction; failures to mount all of the operating parts of a lock on a single body member so that the resulting locks form compact, easy to install units; and inappropriately configured parts of sizes and shapes that prohibit installation of locks embodying such proposals in conventionally configured door lock mounting openings.

3. The Cross-Referenced Disconnect Cases

The present invention and the inventions described in the several referenced Disconnect Cases represent the work products of a continuous and continuing development program which began nearly a decade ago.

The several handle disconnect systems described in the referenced Disconnect Cases were developed by coworkers operating, in some instances independently, and in other instances jointly, as is reflected in the naming of sole and joint inventors. Many of the disconnect system features claimed in separate ones of the referenced Disconnect Cases were developed substantially concurrently.

Where a claim in one of the referenced Disconnect Cases is found to be generic to a development concept utilized in another of these cases, it should be understood that care has been taken to present the generic claim in the case which describes the earliest development of a species that will support the generic claim. In this manner, a careful effort has been made to establish clear lines of demarcation among the claimed subjects matter of this and the several referenced Disconnect Cases. No two of these cases include claims of identical scope.

SUMMARY OF THE INVENTION

The present invention overcomes the foregoing and other drawbacks of the prior proposals by providing a novel and improved, reliable and durable, handleoperated door lock which includes a simple but effective key-controlled disconnect linkage for selectively drivingly connecting and disconnecting an operating handle and a spring-projected slide bolt.

A door lock embodying principles of the present invention preferably includes a support structure or body having side and back walls which cooperate to define a forwardly-facing recess. A bolt is slidably supported on the body at a location behind the back wall. The bolt is movable between projected and retracted positions with respect to the body, and a compression coil spring biases the bolt toward its projected position. A handle is supported on the body for swinging movement between a nested position and an operating position.

A key-controlled disconnect linkage has a locking member which is movable between locked and unlocked positions. A disconnect member is moved by the locking member between positions wherein the disconnect member selectively drivingly connects and disconnects the handle and the bolt. When the locking member is in its locked position, the disconnect member disconnects the handle and the bolt such that movement of the handle will cause no corresponding movement of the bolt. When the locking member is in its unlocked position, the disconnect member is operable to drivingly connect the handle and the bolt such that, when the handle is moved out of its nested position to an operating position, the bolt is retracted.

The disconnect linkage includes several improvements over previously proposed handle disconnect systems. It includes a disconnect member which extends longitudinally alongside and is pivotally mounted on the bolt. An inner end of the disconnect member extends into a receiving formation provided in the bolt where it may be engaged by the handle. The outer end of the disconnect member engages a key-operated locking member which is operable to pivot the disconnect linkage relative to the bolt between connecting and disconnecting positions. When the disconnect member is in its connecting position, the inner end is positioned to engage the handle to provide a driving connection between the handle and the bolt. When the disconnect member is in its disconnect position, the inner end is moved to a position wherein it will not be engaged by the handle, whereby no driving connection is provided between the handle and the bolt.

A feature of locks embodying the preferred practice of the present invention is that conventional lock bodies and handles may be utilized thereby giving these locks substantially the same dimensional configurations as previously proposed locks which had no handle disconnect features. Moreover, since the disconnect functions of these locks are carried out principally at shielded locations within their slide bolt housings, the locks are not significantly different in appearance from previously proposed paddle locks which had no disconnect features.

As will be apparent from the foregoing summary, a feature of the present invention lies in the provision of a novel and improved door lock with a key-controlled disconnect system for selectively drivingly connecting and disconnecting the handle and the bolt.

These and other features and a fuller understanding of the present invention may be had by referring to the following detailed description and claims taken in conjunction with the accompanying drawings.

DESCRIPTION OF THE PREFERRED EMBODIMENT

Figure 1:
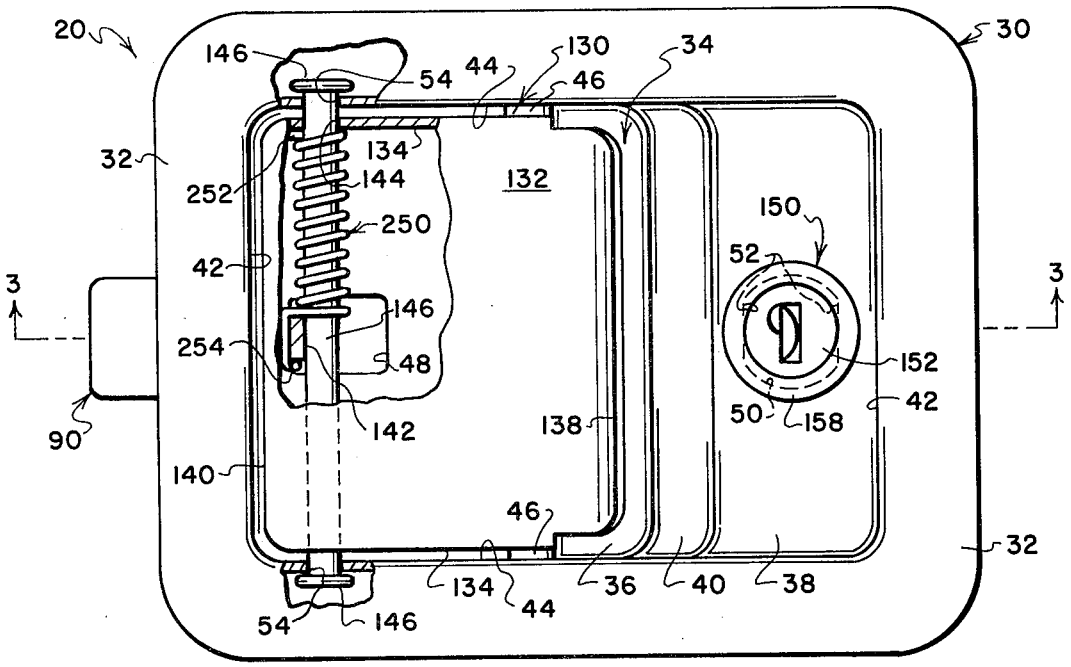
FIG. 1 is a front side elevational view of a lock embodying the present invention with portions broken away to permit underlying components to be viewed, the components of the lock being positioned in an unlocked attitude, with the handle nested and the bolt projected.

Referring to FIGS. 1-6, a key-controlled, paddle-handle, flush-mountable lock embodying the preferred practice of the present invention is indicated generally by the numberal 20. The lock 20 is adapted to be supported on such structures as a swinging door (not shown) for relative movement therewith to bring the lock 20 into and out of juxtaposition with a suitably configured strike (not shown) supported on a door frame or other structure (not shown). The manner in which locks of this general type are mounted on doors is well known to those skilled in the art. The mounting of such locks is described and illustrated in such patents as Pastva, Jr., U.S. Pat. No. 3,668,907.

In general, the lock 20 includes a recessed body 30 having a bolt housing 60 welded to the rear side of the body 30. The bolt housing 60 and the back wall of the body 30 cooperate to define an elongate passage 70. A bolt 90 is slidably carried in the passage 70 for movement between retracted and projected positions. A pair of compression coil springs 110 bias the bolt 90 toward its projected position. A paddle handle 130 is pivotally carried on the body 30 for movement between nested and operating positions. A key control 150 and a disconnect member 180 are provided for selectively drivingly connecting and disconnecting the handle 130 and the bolt 90. A handle return spring 250 biases the handle 130 toward its nested position.

The body 30 is a rectangular, pan-shaped metal stamping having a perimetrically extending flange 32 which surrounds a forwardly facing recess 34. Left and right back wall portions 36, 38 define levels of different depths in opposite end portions of the recess 34. An inclined back wall portion 40 interconnects the left and right back wall portions 36, 38. Forwardly extending end walls 42 and side walls 44 connect the back wall portions 36, 38, 40 with the flange 32.

Other features of the body 30 include a pair of stops 46 formed in the left back wall portion 36. The stops 46 project into the recess 34 at locations near the side walls 44, and are engaged by the handle 130 when the handle 130 is in its nested position. An elongate slot 48 is provided in the left back wall portion 36 at a location overlying the bolt 90. A hole 50 is formed through the right back wall portion 38. Opposite sides of the hole 50 have flat, parallel-extending surfaces 52. Aligned holes 54 are formed through the side walls 44 near their left ends.

The bolt housing 60 is a channel-shaped sheet metal stamping having a bottom wall 62, a pair of opposed side walls 64, an end wall 66, and a pair of mounting flanges 68. The flanges 68 overlie and are welded to the rear side of the left back wall portion 36.

Figure 3:
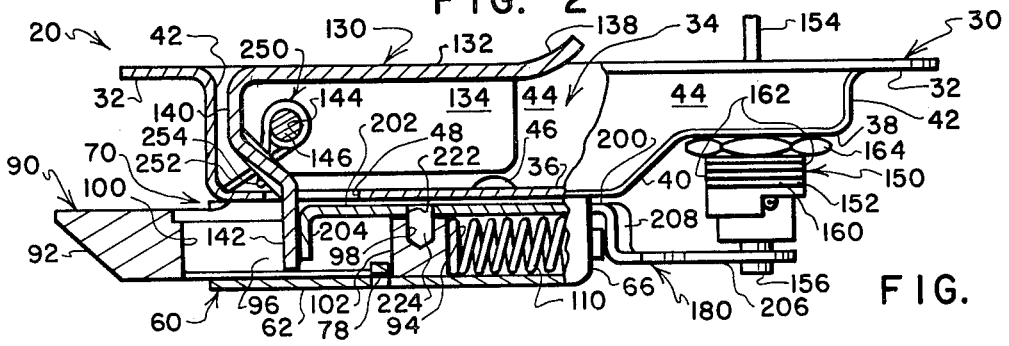
FIG. 3 is a bottom plan view with portions broken away and shown in cross-section as seen from a plane indicated by a line 3—3 in FIG. 1, with the components of the lock positioned as shown in FIG. 1.

The bolt housing 60 cooperates with the left back wall portion 36 to define the passage 70 within which the bolt 90 is guided for sliding movement. The end wall 66 is formed as an integral part of the bottom wall 62, and operates to close a majority of the area of the right end of the bolt passage 70. As is best seen in FIG. 3, the end wall 66 stops short of the rearward surface of the left back wall portion 36, permitting the disconnect member 180 to be slidably carried therebetween. The side walls 64 have a pair of integrally formed locking tabs 72 which are folded to overlie the end wall 66 to reinforce the end wall 66. A pair of dimples 74 (one of which is shown in FIG. 6) are formed on the end wall 66. An inwardly extending stop formation 78 projects upwardly from the bottom wall 62, as seen in FIGS. 3–6. The stop formation 78 is formed as an integral part of the bottom wall 62.

The bolt 90 is a solid metal member which can be formed by conventional casting or powder metallurgy techniques. The bolt 90 has a generally rectangular cross section which corresponds to that of the passage 70. The bolt 90 has a tapered left end 92 configured, as is conventional, to permit the bolt 90 to be retracted in response to slamming engagement with a suitably configured strike (not shown). The bolt 90 has a flat right end 94. The bolt has a receiving formation which preferably takes the form of an elongate slot 96 provided in the central part of the bolt 90. The bolt slot 96 has left and right end walls 100, 102 at its opposite ends. A mounting hole 98 is formed in the bolt 90 near its right end 94.

Figure 4:
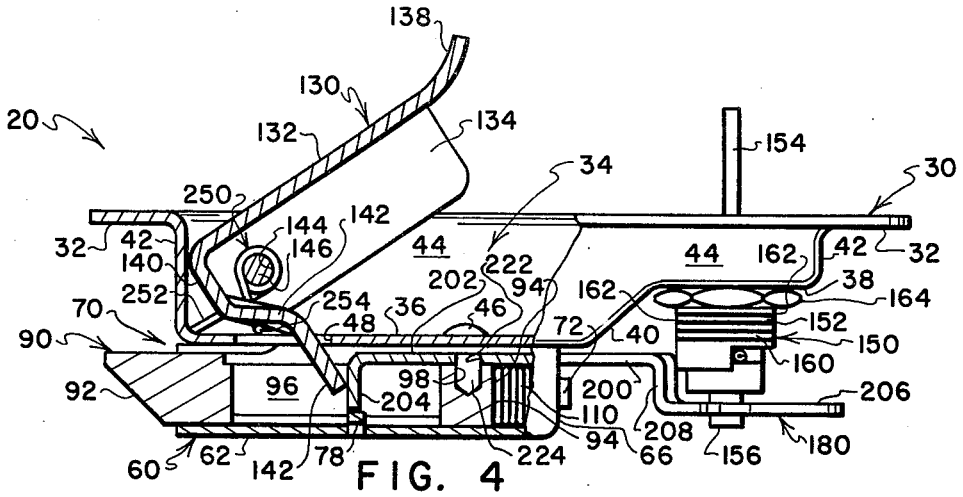
FIG. 4 is a bottom plan view similar to FIG. 3 with the components of the lock being positioned in an unlocked attitude, with the handle extended to an operating position and the bolt retracted.
Figure 5:
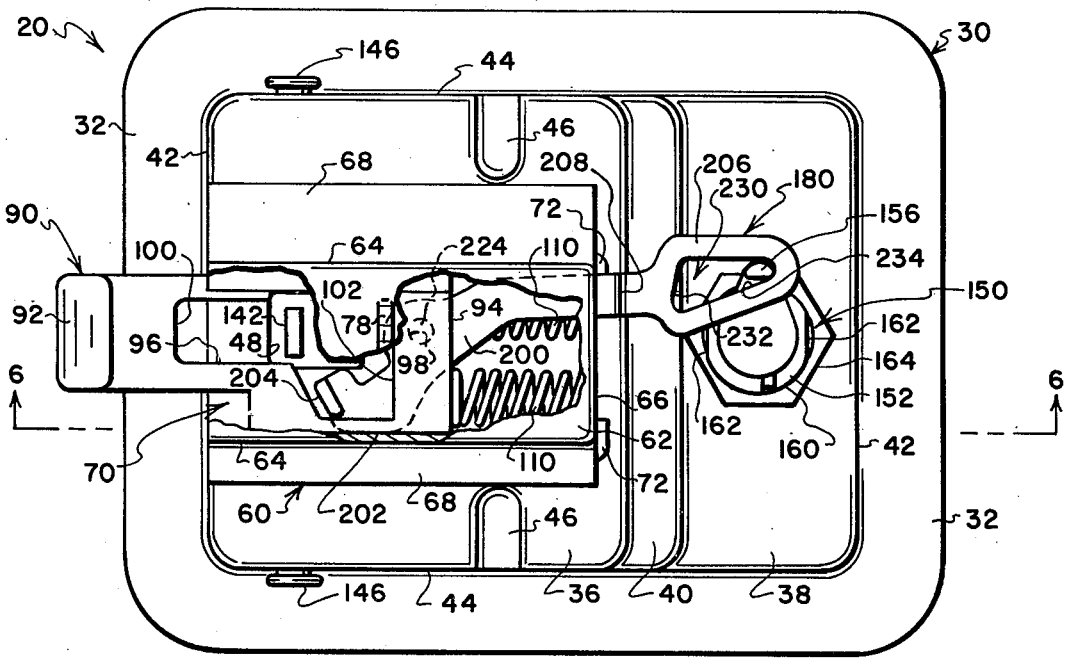
FIG. 5 is a rear side elevational view similar to FIG. 2 with the components of the lock being positioned in a locked attitude, with the handle nested and the bolt projected; and, FIG. 6 is a sectional view similar to FIG. 4 but as seen from a plane indicated by a line 6—6 in FIG. 5, with the components of the lock being positioned in a locked attitude, with the handle extended to an operating position and with the bolt nonetheless still in its projected position.
Figure 6:
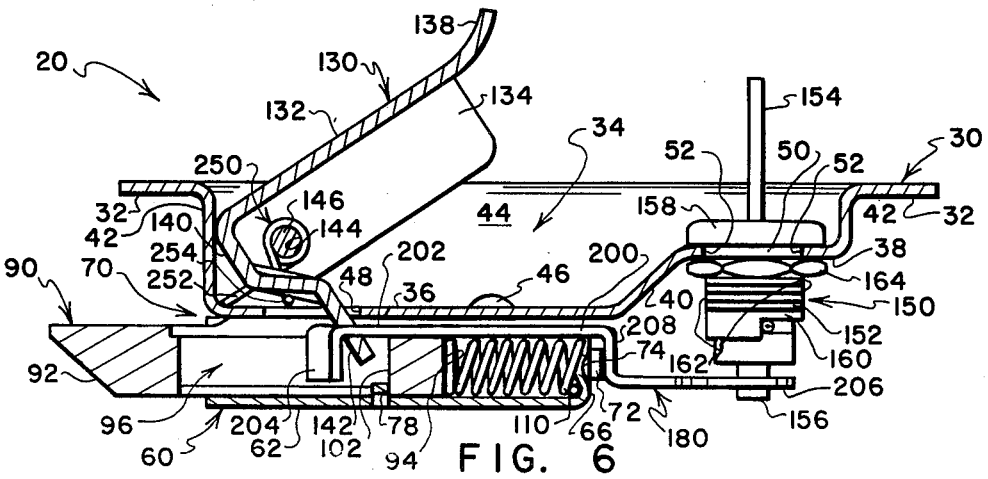

The bolt 90 is movable between a projected or latching position, shown in FIGS. 1–3, 5 and 6, and a retracted or unlatching position shown in FIG. 4. When the bolt 90 is projected, its tapered left end 92 extends beyond the left edge of the body flange 32. When the bolt 90 is retracted, its tapered left end 92 extends substantially evenly with the left edge of the body flange 32.

The compression coil springs 110 are positioned in the passage 70. The springs 110 have left ends which engage the bolt end 94, and right ends which engage the bolt housing end wall 66. The dimples 74 extend into the right ends of the springs 110 to help retain the springs 110 in place. The springs 110 bias the bolt 90 leftwardly toward its projected position, and are compressed to progressively greater degrees as the bolt 90 is retracted.

The paddle handle 130 is a sheet metal stamping having a generally rectangular, substantially flat plate portion 132 and a pair of opposed, inwardly-turned side flanges 134. An outwardly-turned gripping flange 138 is provided at the right end of the handle 130, and an inwardly-turned operating flange 140 is provided at the left end. An operating arm 142 is formed as an integral projection of the operating flange 140.

The handle 130 has aligned mounting holes 144 formed through its side flanges 134. A headed pin 146 extends through the body holes 54 and through the handle mounting holes 144 to pivotally mount the handle 130 on the body 30 at a location between the body side walls 44.

Figure 2:
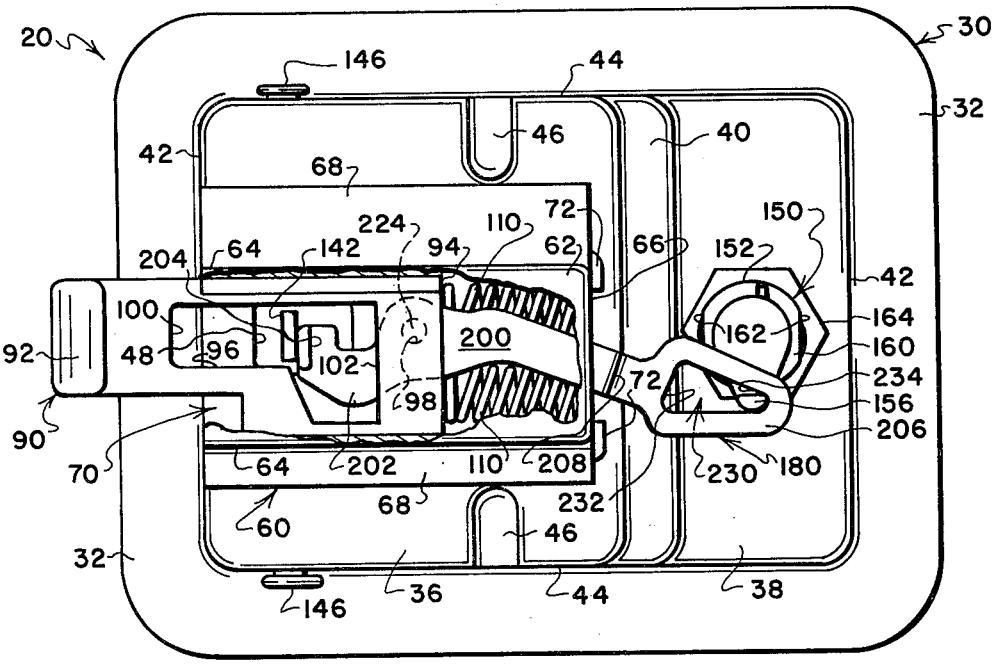
FIG. 2 is a rear side elevational view of the lock of FIG. 1 with portions broken away to permit underlying components to be viewed, with the components of the lock positioned as shown in FIG. 1.

The handle operating arm 142 extends through the back wall slot 48 and into the bolt slot 96. When the handle 130 is in its normal nested position, as shown in FIGS. 1–3, the springs 110 bias the bolt 90 leftwardly toward a position where the right end wall 102 of the bolt slot 96 engages the bolt housing stop formation 78. At the same time, the handle return spring 250 biases the handle 130 clockwise, as viewed in FIG. 3, toward a position where the handle side flanges 134 engage the bottom wall stops 46.

Referring to FIGS. 1 and 3, the handle return spring 250 is a torsion coil spring which has its central portion coiled around the pin 146. The spring 250 has an end 252 which extends away from the pin 146 and engages the back wall portion 36, and an end 254 which is of U-shape and wraps around the operating flange 142.

When the handle 130 is moved out of its nested position to an operating position by pivoting it counterclockwise about the axis of the pin 146, as viewed in FIGS. 4 and 6, the springs 110 may or may not be compressed depending on whether the disconnect member 180 is in what will be termed its "connecting" position or its "disconnecting" position. In FIG. 4, the disconnect member 180 is in its connecting position wherein it provides a driving connection between the handle 130 and the bolt 90. When the disconnect member 180 is in its connecting position, the bolt 90 is caused to retract rightwardly in the passage 70 as the handle 130 pivots out of its nested position. In FIG. 6, the disconnect member 180 is in its disconnecting position. When the disconnect member 180 is in its disconnecting position, it provides no driving connection between the handle 130 and the bolt 90 whereby, when the handle 130 is pivoted about the axis of the pin 146, no corresponding movement of the bolt 90 takes place.

As is seen in FIGS. 3, 4 and 6, the operating arm 142 is normally spaced from the left end surface 100 of the slot 96. The spacing between the slot end surface 100 and the operating arm 142 provides a lost motion connection which permits the bolt 90 to be retracted, i.e. moved rightwardly in the passage 70, without requiring corresponding pivotal movement of the handle 130. This feature is desirable because it provides the lock 20 with a capability to be "slammed" to bring the bolt 90 into latching engagement with a suitably configured strike (not shown) without causing the handle 130 to pivot out of its nested position.

The key control 150 includes a lock cylinder 152 into which a key 154 may be inserted. The key 154 is configured to cooperate with tumblers housed within the cylinder 152 to permit a locking member 156 to be rotated between locked and unlocked positions. The unlocked position of the locking member 156 is shown in FIGS. 1–4. The locked position of the locking member 156 is shown in FIGS. 5 and 6.

The cylinder 152 is provided with an enlarged head 158 and a threaded body 160. A pair of flats 162 are formed on opposite sides of the threaded body 160. The cylinder 152 is positioned with its head 158 engaging the forward surface of the right body portion 38, with its body 160 extending through the hole 50, and with its flats 162 engaging the flat surfaces 52. A locknut 164 is threaded onto the body 160 to hold the cylinder 152 in place on the lock body 30.

While the key control 150 is of a conventional, commercially available type, it is selected from among various commercially available key controls which have particular operational characteristics. These operational characteristics should include key removal capability when the locking member 156 is positioned in either of its locked and unlocked positions. A further characteristic of the key control 150 is that, once the locking member 156 has been positioned in either of its locked or unlocked positions and the key 154 has been removed from the cylinder 152, the key control 150 maintains the locking member 156 in such position.

The disconnect member 180 has an elongate main section 200 which underlies and extends alongside the bottom wall 62 of the bolt housing 60. As is best seen in FIG. 2, the main section 200 has an enlarged left end region 202 which terminates in a rearwardly turned tab 204. The left end tab 204 extends into the bolt slot 96. The disconnect member 180 has a right end region 206 which underlies the key control 150. As is best seen in FIG. 3, a doglegged formation 208 interconnects the main section 200 and the right end region 206.

Referring to FIG. 4, a hole 222 is formed through the main section 200 of the disconnect member 180. A pin 224 extends through the disconnect member hole 222 and into the bolt mounting hole 98. The pin 224 pivotally mounts the disconnect member 180 on the bolt 90.

An elongate slot 230 is formed in the right end region 206. As is best seen in FIG. 2, the slot 230 has an enlarged left end region 232 and a relatively smaller right end region 234. The locking member 156 projects into the slot 230. When the locking member 156 is in its unlocked position, as shown in FIG. 2, it engages one side of the slot 230 and causes the disconnect member 184 to assume a connecting position wherein the right end tab 204 is positioned to engage the handle operating arm 142. When the locking member 156 is in its locked position, as shown in FIG. 5, it engages the opposite side of the slot 230 and causes the disconnect member 184 to assume a disconnecting position wherein the right end tab 204 is positioned out of the path of travel of the handle operating arm 142.

When the locking member 156 is in its unlocked position and thereby causes the disconnect member 180 to assume its connecting position as shown in FIG. 2, pivotal movement of the handle 130 from its nested position, shown in FIG. 3, to an operating position, shown in FIG. 6, will cause the disconnect member 180 to move rightwardly carrying with it the bolt 90. Stated in another way, when the locking member 156 is in its unlocked position, as shown in FIG. 2, the disconnect member 180 is positioned such that a driving connection is established between the handle 130 and the bolt 90. Under these circumstances, movement of the handle 130 to its operating position will cause corresponding retracting movement of the bolt 90, as is illustrated in FIG. 4.

When the locking member 156 is in its locked position and thereby causes the disconnect member 180 to assume its disconnecting position as shown in FIG. 5, pivotal movement of the handle 130 from its nested position to its operating position will cause no movement of the disconnect member 180. Stated in another way, when the locking member 156 is in its locked position, as shown in FIG. 5, the disconnect member 180 is positioned such that no driving connection is established between the handle 130 and the bolt 90. Under these circumstances, the handle 130 can be moved freely without causing any corresponding movement of the bolt 90, as is illustrated in FIG. 6.

The reason for the elongate character of the slot 230 which receives the locking member 156 is to provide the lock 20 with a "slam" capabililty. Regardless of whether the disconnect member 180 is in its connecting or disconnecting position, if the tapered end 92 of the bolt 90 is slammed into engagement with a suitably configured strike (not shown), the bolt 90 will move rightwardly within the passage 70. The elongate character of the slot 230 permits the bolt 90 to move rightwardly, carrying with it the disconnect member 180, without transmitting any forces to the locking member 156.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable door lock, comprising:

(a) a body structure having side and back walls which cooperate to define a forwardly-facing recess, having an opening formed through the back wall, and having housing structure located behind the back wall and cooperating with the back wall to define an elongate slidebolt passage which communicates with the opening formed through the back wall;

(b) an elongate bolt structure slidably supported within the slide bolt passage, the bolt structure being movable along a linear path of travel between a projected position wherein the bolt structure is extended with respect to the body and housing structures, and a retracted position wherein the bolt structure is retracted with respect to the body and housing structures, the bolt structure having a receiving formation communicating with the back wall opening;

(c) a handle structure pivotally mounted on the body structure and being movable about a first axis between a nested position wherein the handle structure is nested with respect to the recess, and an operating position;

(d) a projection carried by the handle structure and being movable therewith, and extending through the back wall opening into the slide-bolt passage and into the receiving formation of the bolt structure;

(e) disconnect linkage means having a first portion extending into the receiving formation for engaging the projection, and having a second portion extending longitudinally of the bolt structure through the slide-bolt passage and out one end of the slide-bolt passage toward the key-control means, the disconnect linkage means being pivotally mounted on the bolt structure and being pivotally movable relative to the bolt structure about a second axis between a connecting position wherein it is operable to drivingly connect the handle and bolt structures such that when the handle structure is moved out of its nested position the bolt structure is caused to retract, and a disconnecting position wherein no driving connection is provided between the handle and bolt structures;

(f) key-control means carried by the body structure and including a locking member movable between locked and unlocked positions; and, (g) the locking member being engageable with the second portion of the disconnect linkage means for moving the disconnect linkage means to its connecting position when the locking member is moved to its unlocked position, and for moving the disconnect linkage means to its disconnecting position when the locking member is moved to its locked position.

2. The door lock of claim 1 wherein the first axis extends in a plane which parallels the linear path of travel of the slide-bolt, and wherein the first axis extends transversely with respect to the linear path of travel.

3. The door lock of claim 2 wherein the second axis extends in a plane which intersects the linear path of travel of the slide-bolt, and wherein the second axis extends transversely with respect to the linear path of travel.

4. The door lock of claim 1 additionally including structure defining a lost motion connection interposed between the disconnect linkage means and the bolt structure for enabling the bolt structure to be moved from its projected position to its retracted position without causing corresponding movement of the disconnect linkage means.

5. The door lock of claim 4 wherein the structure defining a lost motion connection connects the projection and the bolt structure for enabling the bolt structure to be moved from its latching position to its unlatching position without causing corresponding movement of the projection.

6. The door lock of claim 1 additionally including biasing means interposed between the body and handle structures for biasing the handle structure toward its nested position relative to the body structure.

7. The door lock of claim 1 additionally including biasing means interposed between the body and bolt structures for biasing the bolt structure toward its projected position with respect to the housing structure.

8. The door lock of claim 1 wherein:

(a) the second portion of the disconnect linkage means includes a formation having a slot formed therein;

(b) the locking member extends into the slot;

(c) the locking member is operable to move the second slot-carrying formation as the locking member moves between its locked and unlocked positions; and, (d) the movement of the slot-carrying formation by the locking member is operable to effect translatory movement of the first part of disconnect means between its connecting and disconnecting positions.

* * * * *